United States Patent [19]

Yasuda et al.

[11] 3,994,219

[45] Nov. 30, 1976

[54] PRINTER

[75] Inventors: Yuh Yasuda, Higashiyamato; Tsutomu Iesaka, Hino, both of Japan

[73] Assignee: Citizen Watch Co., Ltd., Tokyo, Japan

[22] Filed: Apr. 18, 1975

[21] Appl. No.: 569,156

Related U.S. Application Data

[63] Continuation of Ser. No. 409,778, Oct. 25, 1973, abandoned.

[52] U.S. Cl. ..... 101/93.09; 101/93.14

[51] Int. Cl.[2] ..... B41J 9/12

[58] Field of Search ..... 101/111, 93.04, 93.09, 101/93.29–93.36, 93.48

[56] References Cited

UNITED STATES PATENTS

| | | | |
|---|---|---|---|
| 3,220,343 | 11/1965 | Wasserman | 101/93.09 |
| 3,332,343 | 7/1967 | Sims | 101/93.09 X |
| 3,420,166 | 1/1969 | Ellis et al. | 101/93.29 |
| 3,433,153 | 3/1969 | Harrington et al. | 101/93.09 |
| 3,447,455 | 6/1969 | Shneider | 101/93.48 |
| 3,623,427 | 11/1971 | Buehrmann et al. | 101/93.14 |
| 3,782,278 | 1/1974 | Barnett et al. | 101/93.04 |
| 3,797,387 | 3/1974 | Deeler et al. | 101/93.09 |

OTHER PUBLICATIONS

IBM Technical Disclosure Bulletin, Heydkamp et al., vol. 9, No. 8, Jan. 1967, pp. 1013–1014.

*Primary Examiner*—Edward M. Coven
*Attorney, Agent, or Firm*—Ernest G. Montague; Karl F. Ross; Herbert Dubno

[57] ABSTRACT

A multiplicity of print hammers are supported on one or two planar arrays of leaf springs, the array being parallel to a belt carrying a row of typefaces defining respective character positions, so as to be jointly shiftable parallel to that row between different positions of alignment of each hammer with any one of a set of two or three character positions assigned to it. The hammers are actuated by respective electromagnets whose armatures are normally spaced from the hammers and have faces spanning two or three character positions so as to engage the associated hammers in any of their positions of alignment.

5 Claims, 4 Drawing Figures

PRINTER

This is a continuation of application Ser. No. 409,778, filed Oct. 25, 1973, now abandoned.

BACKGROUND OF THE INVENTION

Field of the Invention

Our present invention relates to a printer with electromagnetically operated print hammers confronting respective character positions on a flexible type carrier.

The recent progress of the computer technique has greatly increased the proportional cost of printing equipment required for data processing.

It has already been proposed to provide means for shifting a group of print hammers together with their associated electromagnets relatively to an associated record sheet in a direction parallel to a row of typefaces defining respective character positions on a type belt so as to reduce the number of the print hammers and electromagnets to a fraction of the total number of characters on the belt and hence to provide a line printer which is less expensive than one having an individual hammer for each character position.

In such a system, however, the large mass to be displaced requires use of a bulky and complex shift mechanism.

Object of the Invention

The object of the invention is to provide a printer of this general type, having a reduced number of print hammers, electromagnets and associated driving circuits, printer which is simple in construction and does not require a shifting of any members other than the print hammers in a direction parallel to the row of character positions on a type belt.

In accordance with our present invention, a group of juxtaposed print hammers are mounted on a common support which is limitedly displaceable parallel to a row of typefaces on a flexible element, such as a belt, defining equispaced character positions which register with respective column positions on a recording medium to be imprinted, the print hammers being spaced apart with a uniform pitch equaling $n$ times that of the character positions with $n$ an integer greater than 1 (specifically 2 or 3). The hammers are actuatable by electromagnets whose armatures have faces each spanning $n$ character positions assigned to the associated hammer, these faces confronting the hammers but being separated therefrom in a normal or rest position by clearances or gaps enabling displacement of the print hammers with their support, independently of the armatures, between actuating strokes driving the hammers into off-normal working positions close to the flexible element.

According to a more particular feature of our invention, the common support includes one or two planar arrays of leaf springs parallel to the row of characters on the type belt, the leaf springs rising from a common base member coacting with the control mechanism for the positioning of the hammers. The base member may be a bar with extremities secured to a pair of flat springs which are fixedly anchored to a stationary structure. The base member may be engageable by electromagnetically releasable detent means, forming part of the control mechanism, including — in the case of two positions of alignment ($n=2$) — a pair of alternately effective pawls.

BRIEF DESCRIPTION OF THE DRAWING

The above and other features of our invention will now be described in detail with reference to the accompanying drawing in which.

SPECIFIC DESCRIPTION

Figure 1:
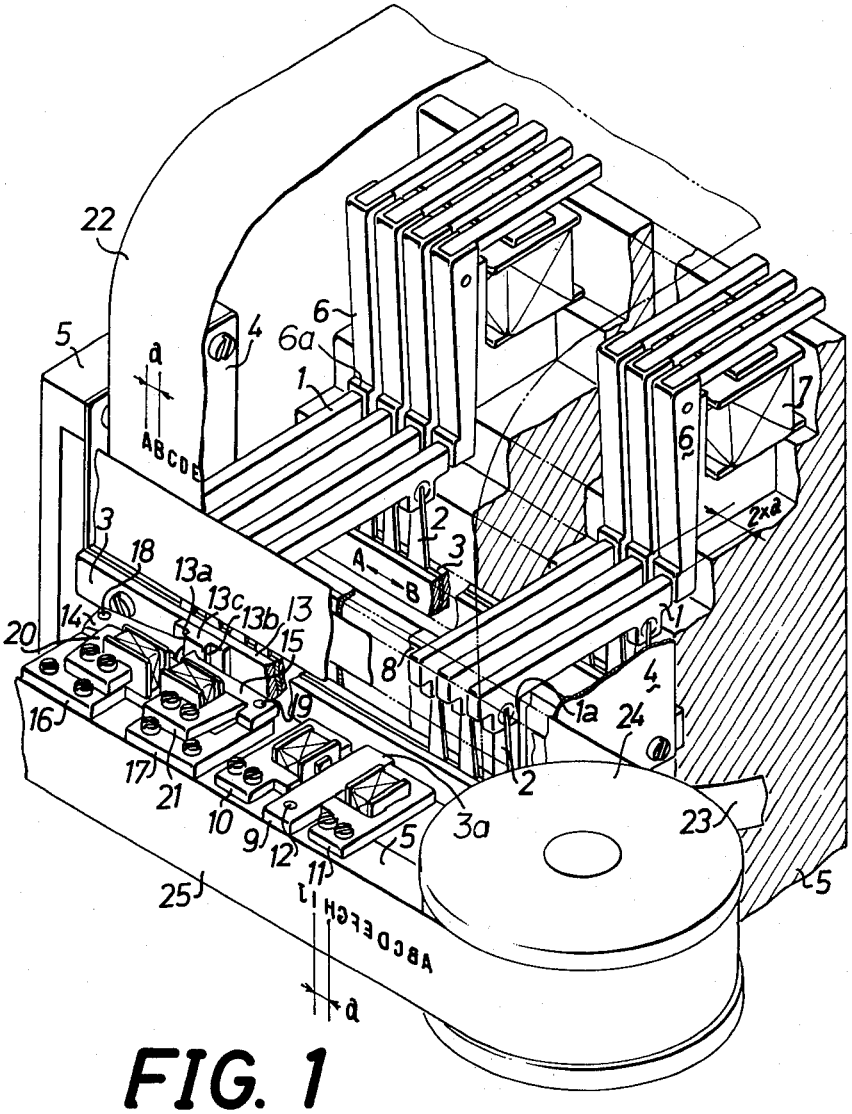
FIG. 1 is a perspective view of a first embodiment of the printer according to the invention.
Figure 2:
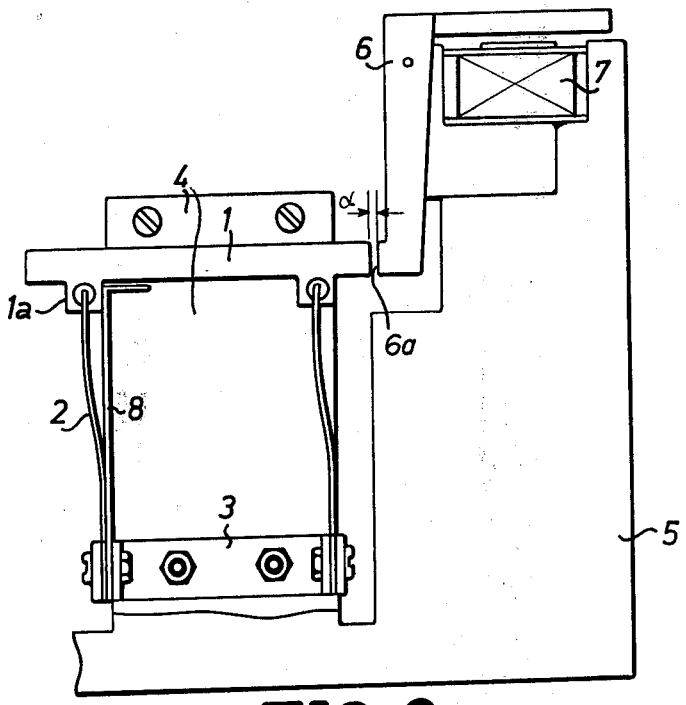
FIG. 2 is a side view of a print-hammer mechanism shown in FIG. 1.

In FIGS. 1 and 2 reference numeral 1 designates a group of print hammers confronting alternate character positions on a typeface carrying belt 25 each hammer 1 is supported at its two ends by the upper ends of two parallel leaf springs 2 forming part of two parallel crenellated spring arrays. The lower ends of the leaf springs 2 of each array are secured to a common base bar 3 which is supported at its two ends by the lower ends of two leaf springs 4 common to both arrays and perpendicular to the planes of the leaf springs 2, the upper end of each leaf spring 4 being secured to a casing 5. This casing 5 carries a group of electromagnets 7 each of which cooperates with an armature 6. A stop plate 8 is fixed at its lower end to the base bar 3, the upper end of the stop plate 8 being normally engaged by an abutment 1*a* of each print hammer 1, to which is secured the upper end of the leaf spring 2; this determines the rest position of the hammer as shown in FIG. 2.

Each armature 6 has a face 6*a* extending across two character positions on the type belt 25 and is separated by a small gap $\alpha$ (FIG. 2) from the associated print hammer 1 when the latter is at rest as shown in FIG. 2.

The common base bar 3 of one spring array is provided with a cutout 3*a* which is loosely traversed by one end of a shift lever 9 whose other end is pivoted to a pin 12. The shift lever 9, which forms part of a position-centered mechanism for the hammer support 2, 3, is flanked by a pair of electromagnets 10, 11 mounted on casing 5. When either one of the electromagnets 10, 11 is energized, the shift lever 9 is swung about the pivot 12 to one side or the other. The same bar 3 carries a stop block 13 provided at its center with a projection 13*c* engaged by either of two detents in the form of pawls 14, 15 during each stroke of any print hammer 1. The pawls 14, 15 are pivoted on pins 18, 19 secured to base plates 16, 17 mounted on the casing 5, respectively. The free ends of the pawls 14, 15 are attracted by a pair of electromagnets 20, 21 in this energized condition and are separated from the electromagnets 20, 21 by a nonillustrated spring in their deenergized condition.

The operation of the printer constructed as above described is as follows.

In the condition shown in FIG. 1, if an electromagnet 7 is energized to attact one arm of its armature 6, the corresponding print hammer 1 is driven by the other arm of that armature against a record sheet 22 and a ribbon 23 interposed between the hammers and the type belt 25. The type belt 25 is longitudinally displaceable by a driving pulley 24 and carries a row of typefaces defining a row of character positions thereon. The embossed characters on the type belt 25 are spaced apart from each other by a distance *a* which is equal to the spacing of the character columns on the record sheet 22.

In the condition shown in FIG. 1, the shift lever 9 is attracted to the right by the lateral electromagnet 11 and the base bar 3 is shifted in the second direction, as indicated by an arrow B, against the action of the leaf springs 4. The bar 3 is held in the position shown in FIG. 1 because the detent or pawl 14 engages with the left-hand edge 13*a* of the projection 13*c* of the stop block 13. After the character imprint has been effected, the print hammer 1 is brought back into its rest position in which it is held against the stop plate 8 by the action of the leaf springs 2 and the gap $\alpha$ is maintained between the print hammer 1 and the armature 6. Then a signal for shifting the print hammers is supplied from a logic circuit (not shown) to the energizing circuits of electromagnets 20, 21 and electromagnets 10, 11. As a result, the electromagnet 20 is energized to attract the pawl 14 which is then disengaged from the left-hand edge 13*a* of the projection 13*c*. Thereafter, the electromagnet 10 is energized to attract the shift lever 9, thereby displacing the group of print hammers 1 to the left (i.e. in the direction shown by the arrow A in FIG. 1) the distance *a* corresponding to the spacing of the character positions on the type belt 25.

At this time, the print hammers 1 are urged against the stop plate 8 by the leaf springs 2 so that the movement of the print hammers 1 in the direction of row of character positions on the belt 25 proceeds smoothly and out of contact with the armatures 6 and all other members of the mechanism. If the shift of the print hammers 1 equals the spacing *a* of the column positions, the spring-loaded detent or pawl 15 engages the right-hand edge 13*b* of the projection 13*c*. As a result, the group of print hammers 1 are held in their left-hand position against the force of the leaf springs 4.

In the latter condition, the electromagnets 7 can be energized to attract their armatures 6 whereby the print hammers 1 strike the embossed characters on the belt 25, thereby imprinting on the record sheet 22 the characters respectively aligned with them.

If, now, the electromagnets 21 and 11 are consecutively energized, the group of print hammers 1 may be shifted in the direction shown by the arrow B in FIG. 1 by the distance *a* corresponding to the spacing of the character positions on the belt 25. Then, again the electromagnets 7 can be energized, to let the armatures 6 strike the point hammers 1 for impacting the type belt 25, thereby imprinting on the record sheet 22 the respective characters now confronting them.

Figure 3:
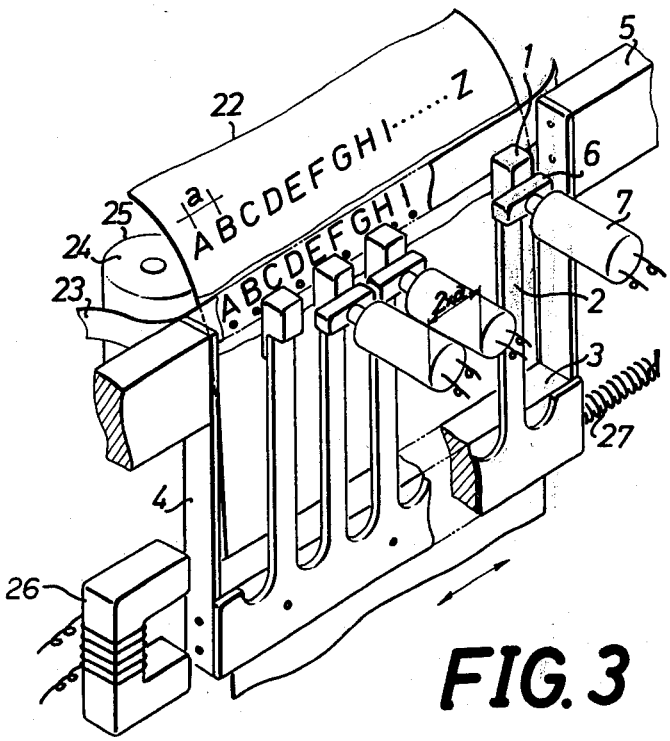
FIG. 3 is a perspective view of a partial modification of the printer shown in FIGS. 1 and 2.

In FIG. 3 we have shown a modification of the printer of FIGS. 1 and 2 wherein in the present embodiment, the group of print hammers 1 are supported by only one crenellated array of leaf springs 2. The reciprocal movement of the group of print hammers 1 in the direction of the row of characters on the type belt 25 is effected with the aid of an electromagnet 26 and a countervailing tension spring 27 coacting with bar 3, the armature of electromagnet 26 being constituted by one of the flat springs 4 secured to the extremities of the bar.

Figure 4:
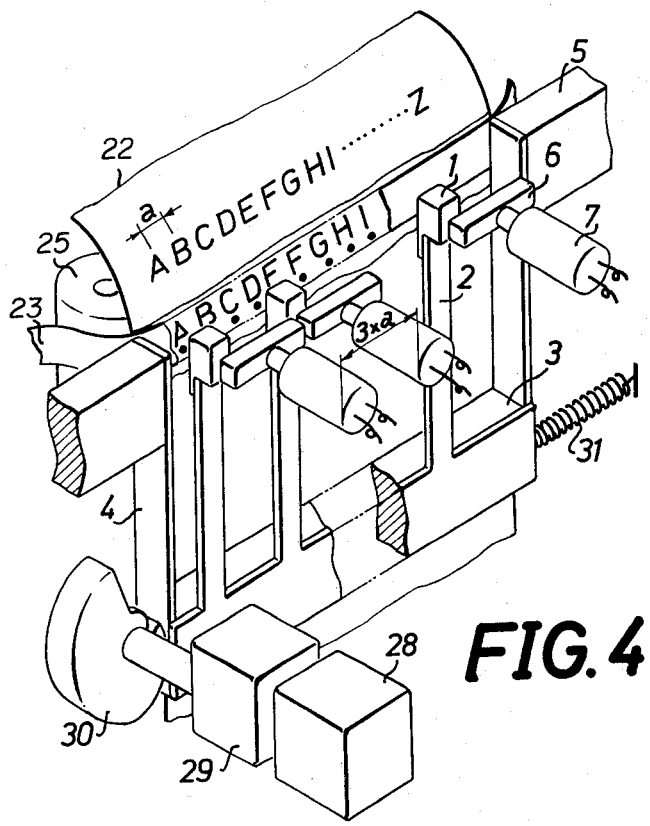
FIG. 4 is a perspective view of another embodiment of the printer according to the invention.

In FIG. 4 we have shown another embodiment wherein each armature 6 has a face spanning three character positions on the type belt 25 and the group of print hammers 1 are shiftable over a distance 2*a*, to line up with any of the associated three characters, with the aid of a control cam 30 and a countervailing compression spring 31 engaging the bar 3, the cam 30 being driven through a clutch 29 from a motor 28.

Thus, our invention is capable of reducing the number of the print hammers, armatures, electromagnets and energizing circuits to a fraction of the number of character positions on the type belt and provides a simple mechanism for displacing only the group of print hammers in the direction of the row of character positions, requiring little energy for this shifting operation.

What is claimed is:

1. A printer comprising:

a flexible element carrying a multiplicity of typefaces efining a row of equispaced character positions registering with respective column positions on an adjoining recording medium to be imprinted;

a group of juxtaposed print hammers spacedly disposed along said element with a uniform pitch equaling *n* times the pitch of said character positions, *n* being an integer greater than 1;

a base member limitedly displaceable parallel to said row;

at least one planar array, parallel to said row, of leaf springs connected to said base member, said leaf springs having free ends carrying said print hammers;

stop means on said base member for arresting said print hammers in positions retracted from said flexible element, said leaf springs being biased to hold said print hammers against said stop means;

control means coupled with said base member for selectively displacing said leaf springs to align said print hammers with any one of a set of *n* character positions assigned to each print hammer;

a group of armatures, one for each print hammer, each having a face spanning *n* character positions confronting the associated print hammer, on a side thereof opposite said flexible element, in any of its positions of alignment with the assigned character positions; and electromagnetic actuating means for said armatures energizable to drive the associated print hammers from a normal rest position into an off-normal working position close to said flexible element, said print hammers being separated from said armatures in said rest position by clearances determined by said stop means enabling displacement of said base member with said print hammers while said armatures remain fixed in a direction parallel to said row.

2. A printer as defined in claim 1 wherein said base member comprises a bar transverse to said leaf springs and a pair of fixedly anchored flat springs, perpendicular to the plane of said array, with extremities engaging the extremities of said bar.

3. A printer as defined in claim 1 wherein said print hammers have abutments connected to said leaf springs, said stop means engaging said abutments in said rest position.

4. A printer as defined in claim 1 wherein said control means comprises electromagnetically releasable detent means engageable with said base member in different positions of alignment of said print hammers.

5. A printer as defined in claim 4 wherein said base member is provided with a projection having a pair of oppositely facing lateral edges, said detent means comprising a first pawl engageable with one of said edges in one position of alignment and a second pawl engageable with the other of said edges in another position of alignment of said print hammers.

* * * * *